US011643922B2

(12) United States Patent
Akresh et al.

(10) Patent No.: US 11,643,922 B2
(45) Date of Patent: May 9, 2023

(54) DISTORTED WELL PRESSURE CORRECTION

(71) Applicant: Saudi Arabian Oil Company, Dhahran (SA)

(72) Inventors: Saud Bin Akresh, Dhahran (SA); Noor Anisur Rahman, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 37 days.

(21) Appl. No.: 17/369,622

(22) Filed: Jul. 7, 2021

(65) Prior Publication Data

US 2023/0011842 A1 Jan. 12, 2023

(51) Int. Cl.
*E21B 47/047* (2012.01)
*E21B 47/07* (2012.01)

(52) U.S. Cl.
CPC ..... *E21B 47/047* (2020.05); *E21B 47/07* (2020.05)

(58) Field of Classification Search
None
See application file for complete search history.

(56) References Cited

U.S. PATENT DOCUMENTS

| | | | | |
|---|---|---|---|---|
| 7,021,405 | B2 | 4/2006 | Proett et al. | |
| 8,136,395 | B2 | 3/2012 | Pop et al. | |
| 9,347,312 | B2 * | 5/2016 | Vincelette | E21B 43/2406 |
| 2009/0216456 | A1 * | 8/2009 | Poe, Jr. | E21B 49/008 702/11 |
| 2012/0158310 | A1 * | 6/2012 | Adams | E21B 47/06 702/12 |
| 2015/0083495 | A1 | 3/2015 | Walker | |
| 2019/0390543 | A1 | 12/2019 | Merino et al. | |

FOREIGN PATENT DOCUMENTS

| | | | |
|---|---|---|---|
| CN | 101769149 | A | 7/2010 |
| CN | 103321634 | A | 9/2013 |
| CN | 105464644 | A | 4/2016 |
| CN | 105569623 | A | 5/2016 |
| CN | 106874666 | A | 6/2017 |
| CN | 107729631 | A | 2/2018 |
| CN | 212642708 | U | 3/2021 |

OTHER PUBLICATIONS

Advanced Reservoir Engineering; "Chapter 1: Well Testing Analysis" Dec. 2005, pp. 1-148.

Ehlig-Economides, Christine Anna; "Well Test Analysis for Wells Produced at a Constant Pressure" Stanford University, Department of Petroleum Engieering, Jun. 1979; pp. 1-125.

(Continued)

*Primary Examiner* — Lina M Cordero
(74) *Attorney, Agent, or Firm* — Bracewell LLP; Constance G. Rhebergen; Brian H. Tompkins

(57) ABSTRACT

Method and system for developing reservoirs, such as hydrocarbon reservoirs or aquifers, including correcting pressure transient test data to account for variations of fluid density between a gauge depth and a mid-reservoir depth in a wellbore. Gauge depth pressure and temperature measurements, and density correlations are used to estimate mid-reservoir depth pressures, which can be used in a pressure transient analysis.

19 Claims, 7 Drawing Sheets

(56) References Cited

OTHER PUBLICATIONS

Hayworth, W.R.; "Discussion of Reservoir-Fluid Property Correlations—State of the Art" SPE Reservoir Engineering, Nov. 1991; p. 510.
McCain Jr., W.D.; "Reservoir-Fluid Property Correlations—State of the Art" SPE Reservoir Engineering, May 1991; pp. 266-272.
Maizeret, Pierre-David et al.; "Temperature Transients Affect Reservoir-Pressure Estimation During Well Tests: Case Study and Model" SPE 181546, Feb. 2018 SPE Reservoir Evaluation & Engineering; pp. 31-38.
Sidorova, M. et al.; "Do Not Let Temperature Transients Hinder Your Build-Up Pressure Interpretation—Proper Gauge Placement in Highly Productuve Reservoirs in Well Testing Operations" SPE-172278-MS, Nov. 12-14, 2014; pp. 1-12.
Sidorova, M. et al.; "The Value of Transient Temperature Responses in Testing Operations" SPE-172758-MS, SPE Middle East Oil & Gas Show and Conference, Bahrain, Mar. 8-11, 2015; pp. 1-20.
Valiullin, Rim et al.; "Interpretation of Non-Isothermal Testing Data based on the Numerical Simulation" SPE-176589-MS, SPE Russian Petroleum Technology Conference, Russia, Oct. 26-28, 2015; pp. 1-22.

* cited by examiner

700

| | |
|---|---|
| Reservoir Fluid | Water |
| Salinity, ppm | 3,000 |
| Temperature at MRD, °F | 172 |
| GD to MRD, $z_0$, ft | 830 |
| Segments, $n$ | 100 |
| Nodes, $n + 1$ | 101 |

DISTORTED WELL PRESSURE CORRECTION

FIELD

Embodiments relate generally to developing hydrocarbon and water wells, and more particularly to determining and employing corrected well-test pressure data.

BACKGROUND

A well typically includes a wellbore (or a "borehole") that is drilled into the earth to provide access to a geologic formation that resides below the earth's surface (or a "subsurface formation"). A well may facilitate the extraction of natural resources, such as hydrocarbons and water, from a subsurface formation, facilitate the injection of substances into the subsurface formation, or facilitate the evaluation and monitoring of the subsurface formation. In the petroleum industry, hydrocarbon wells are often drilled to extract (or "produce") hydrocarbons, such as oil and gas, from subsurface formations.

Developing a hydrocarbon well for production typically involves a drilling stage, a completion stage and a production stage. The drilling stage involves drilling a wellbore into a portion of the formation that is expected to contain hydrocarbons (often referred to as a "hydrocarbon reservoir" or a "reservoir") or water (often referred to as an "aquifer"). The drilling process is often facilitated by a drilling rig that facilitates a variety of drilling operations, such as operating a drill bit to cut the wellbore. The completion stage involves operations for making the well ready to produce hydrocarbons, such as installing casing, installing production tubing, installing valves for regulating production flow, or pumping substances into the well to prepare the well and reservoir to produce hydrocarbons. The production stage involves producing hydrocarbons from the reservoir by way of the well. During the production stage, the drilling rig is typically replaced with a production tree having valves that are operated to regulate production flow rate and pressure. The production tree is typically connected to a distribution network of midstream facilities, such as tanks, pipelines or vehicles that transport production from the well to downstream facilities, such as refineries or export terminals.

Each stage of developing a hydrocarbon well typically involves operations to promote effective and efficient extraction of hydrocarbons or water from the well. With regard to well drilling operations, a well operator may drill the well with a trajectory that is expect to penetrate one or more productive zones of a hydrocarbon reservoir or aquifer. With regard to completion operations, a well operator may install casing and valve to stabilize the wellbore and provide for control access to one or more portions of the wellbore. With regard to production operations a well operator may regulate well operating flow rates and pressures or engage in stimulation operations in an effort to optimize production from the well. In many instances, operations are planned and executed based on careful assessment of the well and the reservoir.

SUMMARY

Understanding the characteristics of a well can be critical aspects to effectively and efficiently developing hydrocarbon wells. For example, know the pressure in a wellbore at the depth of the formation can be helpful in understanding how fluids flow through the formation rock of the reservoir. In some instances, pressure transient tests, such as buildup tests, pressure drawdown tests, or the like, are conducted to determine responses of well pressure to changes in well flowing conditions, and measurable changes in pressure over time are used to infer reservoir parameters such as flow capacity, average reservoir pressure in the drainage area, reservoir size, boundary and fault locations, wellbore damage, or well deliverability. A pressure buildup test typically includes shutting-in a well until the reservoir pressure stabilizes to an initial level (e.g., closing the well to stop flow from the well for an extended period of time), and subsequently producing the well (e.g., opening the well to enable flow from the well) at a known, constant flow rate while measuring the drop-off in pressure in the wellbore as the pressure decreases and stabilizes below the initial level (e.g., measuring pressure for hours or days following the opening of the well). A pressure drawdown test typically includes producing a well at a known, constant rate until the well pressure to stabilizes at an initial rate (e.g., opening the well to enable flow from the well for an extended period of time), and subsequently shutting-in the well (e.g., closing the well to stop flow from the well) and measuring pressure in the wellbore as the pressure increases and stabilizes (e.g., measuring pressure for hours or days following the shut-in of the well).

In many instances, pressure transient analysis is conducted on pressure transient data (e.g., the pressure data obtained from a pressure transient test) to determine how the reservoir pressure changes in response to changes in the well flowing conditions, and the pressure changes are used to determined various characteristics of the well and the reservoir. A field development plan (FDP) defining parameters for developing the reservoir and the well may be determined based on the characteristics, and the well and reservoir may be developed in accordance with the FDP.

Pressure transient analysis is generally dependent on accurate pressure transient data, including pressure measurements that accurately reflect the response of reservoir pressure. This is important for determining an accurate pressure profile for a period of time, but can be even more important in determining accurate pressure derivative profiles, which reflect the rate of changes in pressure over time and are generally more sensitive of inaccurate data. Unfortunately, reservoir pressure data is often an estimation based on pressure measurements made away from the actual location of the reservoir, which can introduce inaccuracies that skew the pressure transient analysis. For example, pressure transient tests often involve collecting pressure measurements from a pressure gauge located in the wellbore some distance above the reservoir, and estimating "mid-reservoir depth" pressures based on the "gauge" pressures obtained from the pressure gauges. Traditional estimation techniques fail to account for many factors across the depth interval extending from the gauge depth to the mid-reservoir depth, which can distort estimated reservoir pressures and detrimentally impact the accuracy of a pressure transient analysis thereof. This can be increasing important in highly permeable (or "prolific" reservoirs), where the actual change in pressure due to the opening or closing of the well is relatively low and, as a result, the variations of density have a relatively significant impact on the pressure readings and estimations.

Provided are systems and method for developing reservoirs, such as hydrocarbon reservoirs or aquifers, that employ correcting (or "salvaging") transient pressure estimations. In some embodiments, pressure transient test data is corrected to account for variations of fluid density between a gauge depth (GD) and a mid-reservoir depth (MRD) in a wellbore. In some embodiments, a pressure transient analysis is conducted using the corrected pressure transient test data, and the results are used to determine one or more reservoir development parameters that are employed to develop the reservoir.

Provided in some embodiments is a method of developing a reservoir that includes the following: obtaining transient pressure test data including gauge depth measurements for a wellbore of a well extending into the reservoir, the gauge depth located at a distance above a mid-reservoir depth in the wellbore, the wellbore gauge measurements including, for each of different instants of time of a time period: a measurement of pressure obtained by way of a pressure gauge located at the gauge depth in the wellbore; and a measurement of temperature obtained by way of a temperature gauge located at the gauge depth in the wellbore, determining a depth interval extending between the gauge depth and the mid-reservoir depth in the wellbore; dividing the depth interval into a series of consecutive nodes extending across the depth interval, where each of the nodes represents a respective depth within the depth interval, where a first node of the series of consecutive nodes corresponds to the gauge depth and a last node of the series of consecutive nodes corresponds to the mid-reservoir depth, and intermediate nodes are defined by the nodes located between the first node and the last node; for each instant of time of the instants of time: determining, based on the measurement of pressure for the instant of time and the measurement of temperature for the instant of time, a first density of wellbore fluid; associating, with the first node of the series of consecutive nodes, the measurement of pressure for the instant of time, the measurement of temperature for the instant of time, and the first density of wellbore fluid; for each intermediate node: determining, based on the measurement of temperature for the instant of time associated with the first node, an estimated temperature for the intermediate node and associating the estimated temperature with the intermediate node; and determining, based on the estimated temperature for the intermediate node, an estimated density for the intermediate node and associating the estimated density with the intermediate node; determining, based on the measurement of temperature for the instant of time associated with the first node, an estimated temperature at the mid-reservoir depth and associating the estimated temperature with the last node; determining, based on the estimated temperature at the mid-reservoir depth associated with the last node, an estimated density for the last node and associating the estimated density with the last node; for each of the intermediate nodes and the last node: determining, based on the estimated density associated with the node, an estimated pressure for the node and associating the estimated pressure with the node; for each of pair of consecutive nodes of the series of consecutive nodes, determining an absolute difference between the pressures associated with the pair of consecutive nodes; determining a sum of the absolute differences of the pressures; determining whether the sum of the absolute differences of the pressures is below a specified tolerance value; in response to determining that the sum of the absolute differences of the pressures is below the specified tolerance value, determining the estimated pressure associated with the last node to be a corrected mid-reservoir pressure for the instant of time; determining, based on the corrected mid-reservoir depth pressures determined for the instants of time, corrected pressure transient test data including a corrected mid-reservoir pressure profile for the period of time including the corrected mid-reservoir depth pressures determined for the instants of time; determining, based on the corrected pressure transient test data, reservoir development parameters; and developing the reservoir based on the reservoir development parameters.

In some embodiments, the specified tolerance value is user specified. In some embodiments, the specified tolerance value is in the range of $10^{-8}$ to $10^{-5}$ pounds per square inch. In certain embodiments, determining reservoir development parameters includes conducting a pressure transient analysis of the mid-reservoir pressure for the period of time to determine a derivative of pressure over the time period, and the reservoir development parameters are determined based on the derivative of pressure over the period of time. In some embodiments, the reservoir development parameters include a well operating pressure or a well operating flow rate, and where developing the reservoir includes operating the well in accordance with the well operating pressure or the well operating flow rate. In certain embodiments, the reservoir includes a hydrocarbon reservoir or an aquifer.

Provided in some embodiments is reservoir development system that includes the following: a pressure gauge located at a gauge depth in a wellbore of a well extending into the reservoir, the gauge depth located at a distance above a mid-reservoir depth in the wellbore; a temperature gauge located at the gauge depth in the wellbore; and a well control system adapted to perform the following operations: obtaining transient pressure test data including gauge depth measurements for the wellbore, the gauge measurements including, for each of different instants of time of a time period: a measurement of pressure obtained by way of the pressure gauge located at the gauge depth in the wellbore; and a measurement of temperature obtained by way of the temperature gauge located at the gauge depth in the wellbore, determining a depth interval extending between the gauge depth and the mid-reservoir depth in the wellbore; dividing the depth interval into a series of consecutive nodes extending across the depth interval, where each of the nodes represents a respective depth within the depth interval, where a first node of the series of consecutive nodes corresponds to the gauge depth and a last node of the series of consecutive nodes corresponds to the mid-reservoir depth, and intermediate nodes are defined by the nodes located between the first node and the last node; for each instant of time of the instants of time: determining, based on the measurement of pressure for the instant of time and the measurement of temperature for the instant of time, a first density of wellbore fluid; associating, with the first node of the series of consecutive nodes, the measurement of pressure for the instant of time, the measurement of temperature for the instant of time, and the first density of wellbore fluid; for each intermediate node: determining, based on the measurement of temperature for the instant of time associated with the first node, an estimated temperature for the intermediate node and associating the estimated temperature with the intermediate node; and determining, based on the estimated temperature for the intermediate node, an estimated density for the intermediate node and associating the estimated density with the intermediate node; determining, based on the measurement of temperature for the instant of time associated with the first node, an estimated temperature at the mid-reservoir depth and associating the estimated temperature with the last node; determining, based on the estimated temperature at the mid-reservoir depth associated with the last node, an estimated density for the last node and associating the estimated density with the last node; for each of the intermediate nodes and the last node: determining, based on the estimated density associated with the node, an estimated pressure for the node and associating the estimated pressure with the node; for each of pair of consecutive nodes of the series of consecutive nodes, determining an absolute difference between the pressures associated with the pair of consecutive nodes; determining a sum of the absolute differences of the pressures; determining whether the sum of the absolute differences of the pressures is below a specified tolerance value; in response to determining that the sum of the absolute differences of the pressures is below the specified tolerance value, determining the estimated pressure associated with the last node to be a corrected mid-reservoir pressure for the instant of time; determining, based on the corrected mid-reservoir depth pressures determined for the instants of time, corrected pressure transient test data including a corrected mid-reservoir pressure profile for the period of time including the corrected mid-reservoir depth pressures determined for the instants of time; determining, based on the corrected pressure transient test data, reservoir development parameters; and developing the reservoir based on the reservoir development parameters.

In some embodiments, the specified tolerance value is in the range of $10^{-8}$ to $10^{-5}$ pounds per square inch. In certain embodiments, determining reservoir development parameters includes conducting a pressure transient analysis of the mid-reservoir pressure for the period of time to determine a derivative of pressure over the time period, and the reservoir development parameters are determined based on the derivative of pressure over the period of time. In some embodiments, the reservoir development parameters include a well operating pressure or a well operating flow rate, and where developing the reservoir includes controlling operation of the well in accordance with the well operating pressure or the well operating flow rate. In certain embodiments, the reservoir includes a hydrocarbon reservoir or an aquifer.

Provided in some embodiments is a non-transitory computer readable storage medium including program instructions stored thereon that are executable by a processor to cause the following operations for developing a reservoir, the method including: obtaining transient pressure test data including gauge depth measurements for a wellbore of a well extending into the reservoir, the gauge depth located at a distance above a mid-reservoir depth in the wellbore, the wellbore gauge measurements including, for each of different instants of time of a time period: a measurement of pressure obtained by way of a pressure gauge located at the gauge depth in the wellbore; and a measurement of temperature obtained by way of a temperature gauge located at the gauge depth in the wellbore, determining a depth interval extending between the gauge depth and the mid-reservoir depth in the wellbore; dividing the depth interval into a series of consecutive nodes extending across the depth interval, where each of the nodes represents a respective depth within the depth interval, where a first node of the series of consecutive nodes corresponds to the gauge depth and a last node of the series of consecutive nodes corresponds to the mid-reservoir depth, and intermediate nodes are defined by the nodes located between the first node and the last node; for each instant of time of the instants of time: determining, based on the measurement of pressure for the instant of time and the measurement of temperature for the instant of time, a first density of wellbore fluid; associating, with the first node of the series of consecutive nodes, the measurement of pressure for the instant of time, the measurement of temperature for the instant of time, and the first density of wellbore fluid; for each intermediate node: determining, based on the measurement of temperature for the instant of time associated with the first node, an estimated temperature for the intermediate node and associating the estimated temperature with the intermediate node; and determining, based on the estimated temperature for the intermediate node, an estimated density for the intermediate node and associating the estimated density with the intermediate node; determining, based on the measurement of temperature for the instant of time associated with the first node, an estimated temperature at the mid-reservoir depth and associating the estimated temperature with the last node; determining, based on the estimated temperature at the mid-reservoir depth associated with the last node, an estimated density for the last node and associating the estimated density with the last node; for each of the intermediate nodes and the last node: determining, based on the estimated density associated with the node, an estimated pressure for the node and associating the estimated pressure with the node; for each of pair of consecutive nodes of the series of consecutive nodes, determining an absolute difference between the pressures associated with the pair of consecutive nodes; determining a sum of the absolute differences of the pressures; determining whether the sum of the absolute differences of the pressures is below a specified tolerance value; in response to determining that the sum of the absolute differences of the pressures is below the specified tolerance value, determining the estimated pressure associated with the last node to be a corrected mid-reservoir pressure for the instant of time; determining, based on the corrected mid-reservoir depth pressures determined for the instants of time, corrected pressure transient test data including a corrected mid-reservoir pressure profile for the period of time including the corrected mid-reservoir depth pressures determined for the instants of time; determining, based on the corrected pressure transient test data, reservoir development parameters; and developing the reservoir based on the reservoir development parameters.

In some embodiments, the specified tolerance value is in the range of $10^{-8}$ to $10^{-5}$ pounds per square inch. In certain embodiments, determining reservoir development parameters includes conducting a pressure transient analysis of the mid-reservoir pressure for the period of time to determine a derivative of pressure over the time period, and the reservoir development parameter is determined based on the derivative of pressure over the period of time. In some embodiments, the reservoir development parameters include a well operating pressure or a well operating flow rate, and where developing the reservoir includes controlling operation of the well in accordance with the well operating pressure or the well operating flow rate. In certain embodiments, the reservoir includes a hydrocarbon reservoir or an aquifer.

Provided in some embodiments is a method of developing a reservoir, the method including: obtaining transient pressure test data including gauge depth measurements for a wellbore of a well extending into the reservoir, the gauge depth located at a distance above a mid-reservoir depth in the wellbore, the wellbore gauge measurements including, for each of different instants of time of a time period: a measurement of pressure obtained by way of a pressure gauge located at the gauge depth in the wellbore; and a measurement of temperature obtained by way of a temperature gauge located at the gauge depth in the wellbore, dividing a depth interval extending between the gauge depth and the mid-reservoir depth in the wellbore into a series of consecutive nodes extending across the depth interval, where each of the nodes represents a respective depth within the depth interval, where a first node of the series of consecutive nodes corresponds to the gauge depth and a last node of the series of consecutive nodes corresponds to the mid-reservoir depth, and intermediate nodes are defined by the nodes located between the first node and the last node; for each instant of time of the instants of time: determining, based on the measurement of pressure for the instant of time and the measurement of temperature for the instant of time, a first density of wellbore fluid; for each intermediate node: determining, based on the measurement of temperature for the instant of time, an estimated temperature for the intermediate node; and determining, based on the estimated temperature for the intermediate node, an estimated density for the intermediate node; determining, based on the measurement of temperature for the instant of time, an estimated density for the last node; for each of the intermediate nodes and the last node: determining, based on the estimated density associated with the node, an estimated pressure for the node; determining, based on the estimated pressures determined for the instants of time, corrected pressure transient test data including a corrected mid-reservoir pressure profile for the period of time including the estimated pressures determined for the instants of time; determining, based on the corrected pressure transient test data, reservoir development parameters; and developing the reservoir based on the reservoir development parameters.

Figure 1:
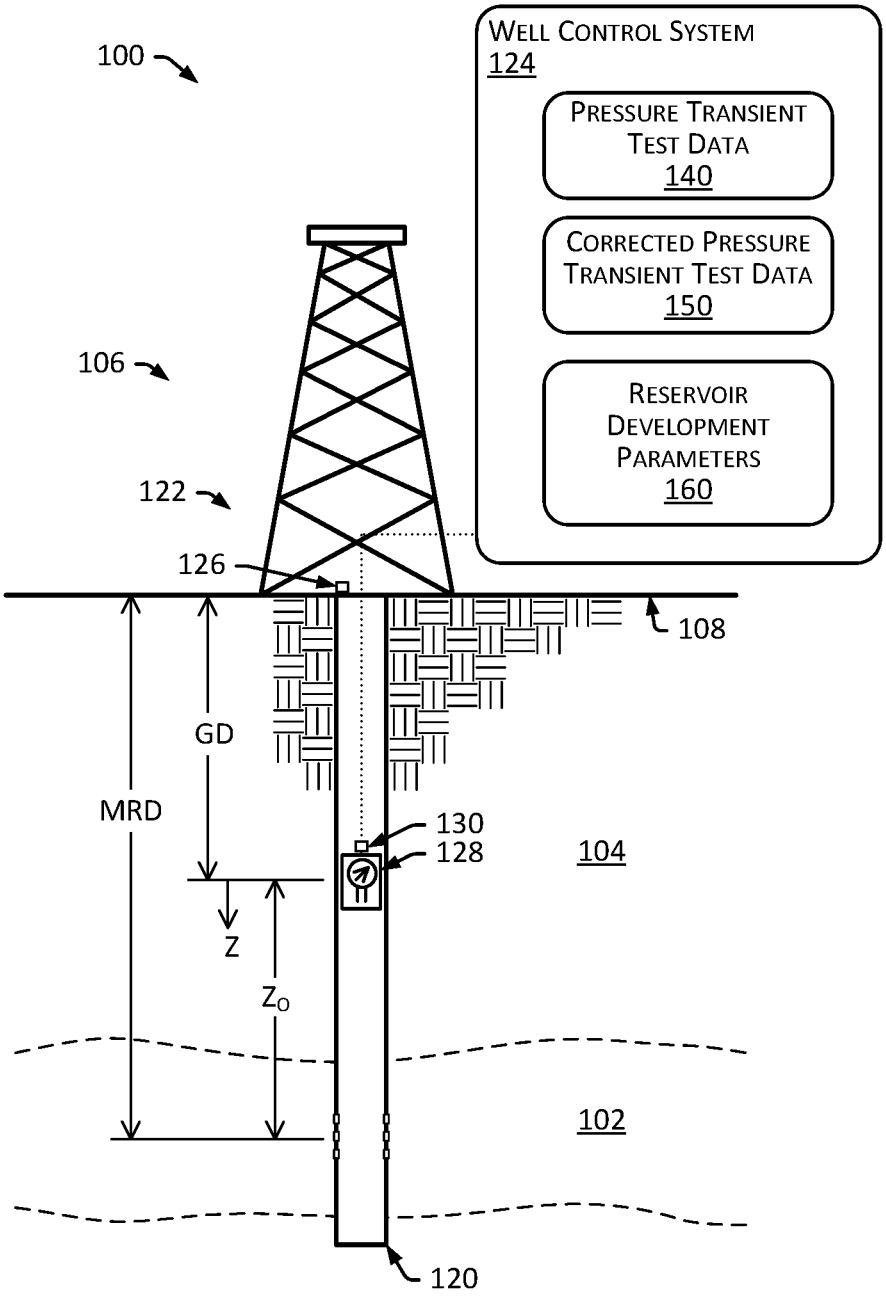
FIG. 1 is diagram that illustrates a well environment in accordance with one or more embodiments.

While this disclosure is susceptible to various modifications and alternative forms, specific embodiments are shown by way of example in the drawings and will be described in detail. The drawings may not be to scale. It should be understood that the drawings and the detailed descriptions are not intended to limit the disclosure to the particular form disclosed, but are intended to disclose modifications, equivalents, and alternatives falling within the scope of the present disclosure as defined by the claims.

DETAILED DESCRIPTION

Described are embodiments of novel systems and method for developing reservoirs, such as hydrocarbon reservoirs or aquifers, that employ correcting (or "salvaging") transient pressure estimations. In some embodiments, pressure transient test data is corrected to account for variations of fluid density between a gauge depth (GD) and a mid-reservoir depth (MRD) in a wellbore. In some embodiments, a pressure transient analysis is be conducted using the corrected pressure transient test data, and the results are used to determine one or more reservoir development parameters that are employed to develop the reservoir.

FIG. 1 is a diagram that illustrates a well environment 100 in accordance with one or more embodiments. In the illustrated embodiment, the well environment 100 includes a reservoir ("reservoir") 102 located in a subsurface formation ("formation") 104 and a well system ("well") 106.

The formation 104 may include a porous or fractured rock formation that resides beneath the earth's surface (or "surface") 108. The reservoir 102 may be a hydrocarbon reservoir defined by a portion of the formation 104 that contains (or that is at least determined or expected to contain) a subsurface pool of hydrocarbons, such as oil and gas. The formation 104 and the reservoir 102 may each include layers of rock having varying characteristics, such as varying degrees of permeability, porosity, and fluid saturation. Alternatively, the reservoir 102 may be an aquifer saturated with desired subsurface water. In the case of the well 106 being operated as a production well, the well 106 may be a hydrocarbon or water production well that is operable to facilitate the extraction of hydrocarbons or water, respectively, (or "production") from the reservoir 102.

The well 106 may include a wellbore 120, a production system 122, and a well control system ("control system") 124. The wellbore 120 may be, for example, a bored hole that extends from the surface 108 into a target zone of the formation 104, such as the reservoir 102. The wellbore 120 may be created, for example, by a drill bit of a drilling system of the well 106 boring through the formation 104 and the reservoir 102. An upper end of the wellbore 120 (e.g., located at or near the surface 108) may be referred to as the "up-hole" end of the wellbore 120. A lower end of the wellbore 120 (e.g., terminating in the formation 104) may be referred to as the "down-hole" end of the wellbore 120.

The production system 122 may include production devices that facilitate that the extraction of production from the reservoir 102 by way of the wellbore 120. For example, the production system 122 may include valves, pumps and sensors that are operable to regulate the flow of production from the wellbore 120 and to monitor production parameters (e.g., production flow rate, temperature, and pressure). The sensors may include, for example, a flow rate sensor 126 that is operable to sense a rate of the flow of production from the wellbore 120, a down-hole pressure sensor 128 that is operable to sense fluid pressure in a lower (or "down-hole") portion of the wellbore 120, and a down-hole temperature sensor 130 that is operable to sense fluid temperature in a lower (or "down-hole") portion of the wellbore 120. In some instances, both pressure and temperature are measured at the same down-hole location simultaneously.

In some embodiments, the down-hole pressure sensor (or "pressure gauge") 128 is disposed in the wellbore 120 at a given distance ("gauge depth" or "GD") below the surface 108, and is operable to sense fluid pressure in the wellbore 120 at the gauge depth (GD). The gauge depth (GD) may be a given distance ($z_o$) above a mid-reservoir depth (MRD). The mid-reservoir depth (MRD) may be defined by a midpoint between upper and lower bounds of the reservoir 102). In some embodiments, the down-hole pressure sensor (or "pressure gauge") 128 is disposed in the wellbore 120 at or about the gauge depth (GD) and is operable to sense a pressure of fluid in the wellbore 120 at or about the gauge depth (GD).

In some embodiments, the well control system 124 is operable to control various operations of the well 106, such as well drilling operations, well completion operations, well production operations, or well or formation remediation operations. For example, the well control system 124 may include a well system memory and a well system processor that are capable of performing the various processing and control operations of the well control system 124 described here. In some embodiments, the well control system 124 includes a computer system that is the same as or similar to that of computer system 1000 described with regard to at least FIG. 8.

In some embodiments, the pressure transient test data 140 for the well 106 is obtained by way of a pressure transient test of the well 106 (e.g., by way of a build-up or draw-down testing of the well 106), and the pressure transient test data 140 is corrected to generate corrected pressure transient test data 150 (e.g., corrected pressure transient test data 150 that accounts for variations of fluid density between the gauge depth (GD) and the mid-reservoir depth (MRD) in the wellbore). The corrected pressure transient test data 150 may be used to determine one or more reservoir development parameters (e.g., a pressure transient analysis may be conducted using the corrected pressure transient test data 150 and the results of the analysis may be used to determine reservoir development parameters 160, such as a production rate, a production pressure, well stimulation, or the like for the well 106), and the reservoir 102 may be developed based on the reservoir development parameters (e.g., the well control system 124 (or another operator of the well 106) may control the well 106 to operate at the production rate or the production pressure, to conduct the prescribed well stimulation, or the like for the well 106). In some embodiments, the determining of the reservoir development parameters includes conducting a pressure transient analysis of the mid-reservoir pressure profile for the period of time to determine a derivative of pressure over the period of time, and the reservoir development parameters are determined based on the derivative of pressure over the time period.

Figure 4:
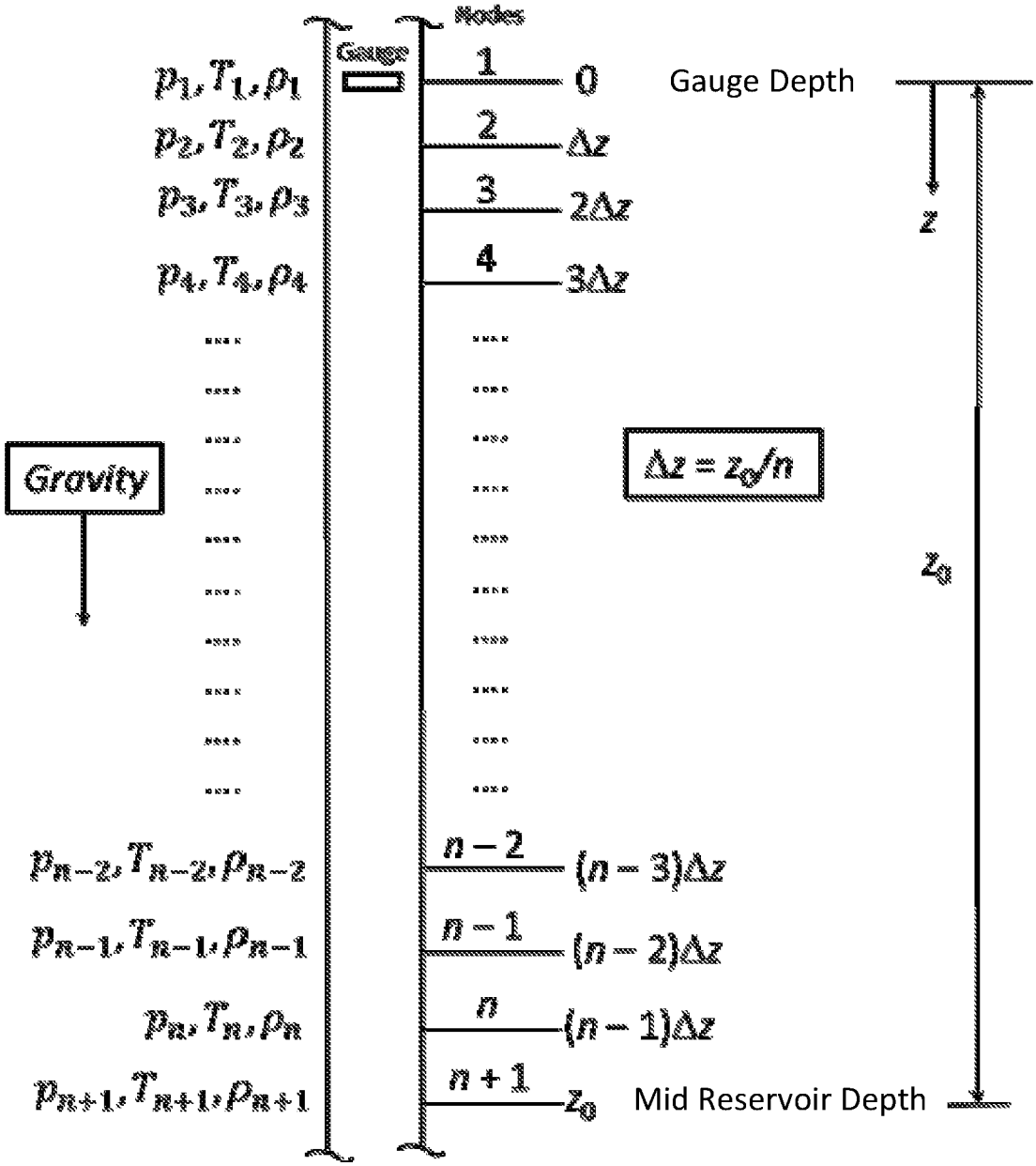
FIG. 4 is a diagram that illustrates a well interval and associated nodes and parameters in accordance with one or more embodiments.

In some embodiments, correction of the pressure transient test data 140 (to generate corrected pressure transient test data 150) includes the well control system 124 (or another operator of the well 106) performing the following: (1) obtaining the transient pressure test data 140 that includes gauge depth measurements for the wellbore 120, including, for each of different instants of time of a time period: a measurement of pressure obtained by way of the pressure gauge 128; and a measurement of temperature obtained by way of the temperature gauge 130 (e.g., with both 128 and 130 located at the same down-hole location); (2) determining a depth interval extending between the gauge depth and the mid-reservoir depth in the wellbore (e.g., as described with regard to FIG. 4); (4) dividing the depth interval into a series of consecutive nodes extending across the depth interval, where each of the nodes represents a respective depth within the depth interval, where a first node of the series of consecutive nodes corresponds to the gauge depth (GD) and a last node of the series of consecutive nodes corresponds to the mid-reservoir depth (MRD), and intermediate nodes are defined by the nodes located between the first node and the last node; (5) for each instant of time of the instants of time: (a) determining, based on the measurement of pressure for the instant of time and the measurement of temperature for the instant of time, a first density of wellbore fluid; (b) associating, with the first node of the series of consecutive nodes, the measurement of pressure for the instant of time, the measurement of temperature for the instant of time, and the first density of wellbore fluid; (c) associating, with the last node of the series of consecutive nodes, the measurement of temperature for the instant of time; (d) for each intermediate node: determining, based on the measurement of temperature for the instant of time associated with the first node, an estimated temperature for the intermediate node and associating the estimated temperature with the intermediate node; and (e) determining, based on the estimated temperature for the intermediate node, an estimated density for the intermediate node and associating the estimated density with the intermediate node; determining an estimated density for the last node and associating the estimated density with the last node; (f) for each of the intermediate nodes and the last node: determining, based on the estimated density associated with the node, an estimated pressure for the node and associating the estimated pressure with the node; (g) for each of pair of consecutive nodes of the series of consecutive nodes, determining an absolute difference between the pressures associated with the pair of consecutive nodes; (h) determining a sum of the absolute differences of the pressures; (i) determining whether the sum of the absolute differences of the pressures is below a specified tolerance value; (j) in response to determining that the sum of the absolute differences of the pressures is below the specified tolerance value, determining that the estimated pressure associated with the last node to be a corrected MRD pressure for the instant of time; (6) determining, based on the mid-reservoir pressures determined for the instants of time, the corrected pressure transient test data 150, including a mid-reservoir pressure profile for the period of time that includes the corrected MRD pressures for the instants of time. In some embodiments, the specified tolerance value is user specified and may be in the range of $10^{-8}$ to $10^{-5}$ pounds per square inch.

Figure 2:
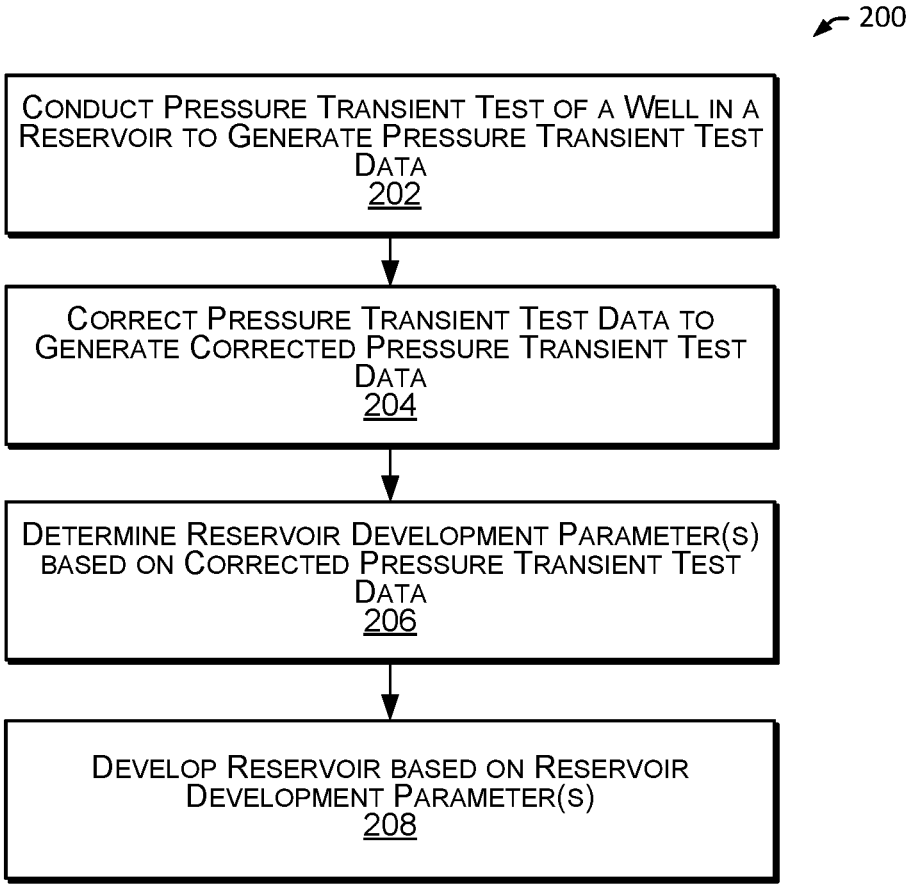
FIG. 2 is a flowchart that illustrates a method of developing a reservoir in accordance with one or more embodiments.

FIG. 2 is a flowchart that illustrates a method 200 of developing a reservoir in accordance with one or more embodiments. In the context of the well 106, some or all of the operations of method 200 may be performed by the well control system 124 (or another operator of the well 106).

In the illustrated embodiment, method 200 includes conducting pressure transient testing of a well in a reservoir to generate pressure transient test data (block 202). This may include conducting a pressure transient test of a well to generate pressure transient test data including wellbore temperature and pressures at a gauge depth in wellbore of the well, for respective instants of a time across a period of time. For example, this may include the well control system 124 (or another operator of the well 106) controlling the production system 122 to conduct a draw-down and build-up testing of the well 106, that includes collecting measurements of fluid pressure and temperature in the wellbore 102 of the well 106 over a period of time of pressure draw-down or pressure build-up.

In the illustrated embodiment, method 200 includes correcting the pressure transient test data to generate corrected pressure transient test data (block 204). This may include generating, based on the pressure and temperatures of the pressure transient data, a pressure profile for the mid-reservoir depth (MRD) that accounts for variations of fluid density between the gauge depth (GD) and the mid-reservoir depth (MRD). For example, this may include the well control system 124 (or another operator of the well 106) correcting the pressure transient test data 140 to generate corrected pressure transient test data 150 that accounts for variations of fluid density between the gauge depth (GD) and the mid-reservoir depth (MRD) in the wellbore 120. Embodiments relating to correcting pressure transient test data are described in more detail, for example, with regard to method 300 of FIG. 3.

In the illustrated embodiment, method 200 includes determining one or more reservoir development parameters based on the corrected pressure transient test data (block 206). This may include determining one or more operational parameters for one or more wells in the reservoir, based on the corrected pressure transient test data. For example, this may include the well control system 124 (or another operator of the well 106) conducting a pressure transient analysis using the corrected pressure transient test data 150 and using the results of the analysis to determine one or more reservoir development parameters 160, such as a production rate, a production pressure, well stimulation, or the like for the well 106. In some embodiments, the determining of reservoir development parameters includes conducting a pressure transient analysis of a corrected mid-reservoir pressure profile for the period of time to determine a derivative of pressure (e.g., a pressure derivative curve) over the period of time, and determining the reservoir development parameters based on the derivative of pressure.

In the illustrated embodiment, method 200 includes developing the reservoir based on the one or more reservoir development parameters determined (block 208). This may include engaging in operations to develop the reservoir in accordance with the one or more reservoir development parameters determined. For example, this may include the well control system 124 (or another operator of the well 106) controlling the production system 122 of the well 106 to operate the well 106 at the production rate or the production pressure, to conduct the prescribed well stimulation, or the like for the well 106).

Regarding correcting pressure transient test data (to generate corrected pressure transient test data), the following describes rational and embodiments for such determinations. As noted, embodiments incorporate techniques for the accurate magnitudes of the density in compliance with the in-situ pressure and temperature distributions, from the gauge depth (GD) down to the mid-reservoir depth (MRD) in the wellbore. The magnitudes of the density provide for a calculation of a "corrected" transient pressure at the mid-reservoir depth (MRD).

Applying the condition of equilibrium in borehole hydraulics, at a given time (t), the following represents the relationship between the pressure at the mid-reservoir depth ($p_{MRD}$) and the pressure at the gauge depth ($p_{GD}$):

$$p_{MRD}(t) = P_{GD}(t) + \frac{1}{144}\int_0^{z_0} \rho_z dz \tag{1}$$

where $$\rho_z = \rho_z(p(t), T(t), \text{Composition}) \tag{2}$$

and $p_{MRD}$ is pressure at mid-reservoir depth (MRD) as function of time (e.g., in pounds-per-square inch absolute (psia));

$p_{GD}$ is pressure at gauge depth (GD) as function of time (e.g., in psia);

$\rho_z$ is fluid density for the associated fluid at depth z at the given time (t) (e.g., in pound mass per cubic foot ($lb_m/ft^3$)) (e.g., determined as a function of the pressure, the temperature and the composition for the associated fluid at depth z at the given time (t));

z is true vertical depth at the associated point in the wellbore (toward mid-reservoir depth (MRD)) from the gauge depth (GD) (e.g., in feet (ft));

$z_0$ is true vertical distance from gauge depth to mid reservoir depth (e.g., in feet);

MRD is mid-reservoir depth (e.g., in feet);

GD is gauge depth (e.g., in feet); and t is a time variable (e.g., in hours).

Equation 1 illustrates a non-linear characteristic given that the density within the integral remains unknown because it is a function of the pressure ($p_{MRD}$) that is sought. Notably, the raw pressure data, $p_{GD}$, may not be capable of representing the characteristics of the well and the reservoir, while the corrected pressure data, $p_{MRD}$, is supposed to restore the characteristics of the well and the reservoir. The temperature distribution over the depth interval ($z_0$) from the gauge depth (GD) to the mid-reservoir depth (MRD) can be determined, for example, from the measured reservoir temperature (e.g., at the temperature gauge) and a known geothermal gradient for the corresponding region of the formation. The fluid density ($\rho_z$) for a given location can be determined based on known correlations of fluid density ($\rho_z$) with reservoir fluid pressure, temperature and composition, such as the correlations provided in "Reservoir-Fluid Property Correlations—State of the Art," McCain, W. D. Jr., SPE Reservoir Engineering 6(2), pp. 266-272, May 1991. For example, given a volume of reservoir fluid having a known fluid pressure, temperature and composition, the correlations can be assessed to determine a fluid density ($\rho_z$) associated with the fluid pressure, temperature and composition, and the fluid density ($\rho_z$) can be associated with that volume of reservoir fluid.

Equation 1 is generally considered non-linear due to pressure and density at a given point, and, thus, the integral cannot be evaluated analytically and can be evaluated numerically with an iterative technique that seeks pressure at the mid-reservoir depth (MRD), considered the de facto center of the reservoir. Referring to the segments and the nodes presented in FIG. 4, Equation 1 can be discretized to the following implicit form for the (k+1)th iteration for the pressure at the mid-reservoir depth (MRD) at a given time (t):

$$p_{MRD}^{k+1}(t) = p_{GD}(t) + \frac{\Delta z}{288}\sum_{j=1}^{n}\left(\rho_{zj}^{k} + \rho_{zj+1}^{k}\right) \tag{3}$$

where:

j is the index for the node;

k is the index for iteration;

n is the number of segments, creating (n+1) nodes;

$\Delta z$ is segment thickness (e.g., in feet);

$\rho_{zj}$ is fluid density at jth node as a function of $p_j$ and $T_j$ (e.g., in $lb_m/ft^3$);

$p_j$ is pressure at jth node (e.g., in $lb_m/ft^3$);

$T_{GD}$ is temperature at gauge depth as function of time (e.g., in degrees Fahrenheit); and $T_j$ is temperature at jth node (e.g., in degrees Fahrenheit).

The density values on the right hand side of Equation 3 remain at the previous kth iteration when the pressure is updated to the current (k+1)th iteration. Recall that the raw pressure data, expressed by $p_{GD}$ on the right hand side in Equation 3, may have been distorted and may not accurately characterize the well and the reservoir. Also note that the corrected pressure data, expressed by $p_{MRD}$ on the left hand side, is supposed to restore the true characteristics of the well and the reservoir, which is an objective of the well test.

In each iteration, the cumulative of the absolute value of the adjusted amount between two successive iterative values of pressure over each node can be monitored and compared with an assigned value of tolerance. The iteration with the data point at a given time t may continue until the following condition is not met between two successive iterations between the kth and the (k+1)th iterations over the 2nd to the (n+1)th nodes:

$$\sum_{j=2}^{n+1}\left|p_j^{k+1}(t)-p_j^k(t)\right| \leq \text{Tolerance} \tag{4}$$

where:

$p_j$ is pressure at jth node (e.g., in psia).

Such an assessment may provide flexibility of setting a level of tolerance (in Equation 4) to a value that provides a suitable level of accuracy in the computed pressure at the mid-reservoir depth (MRD). The tolerance values in a limited range (e.g., from $10^{-8}$ to $10^{-5}$) may provide fast convergence of the iterative scheme. Such a tolerance condition (in Equation 4) may provide for the density and the pressure at a point in the wellbore being consistent, while being inter-dependent.

Once a set of satisfactory pressure in each node at a given time satisfies the condition in Equation 4 following an iteration, the pressure at (n+1)th node, $p_{n+1}$, is accepted as the corrected pressure at the mid-reservoir depth (MRD). This process may continue, until some or all of the data points of the pressure transient data (e.g., potentially hundreds of thousands of data points) are corrected. As described, the corrected pressure data may be assessed using a known pressure transient analysis to extract the reliable well and reservoir parameters.

Figure 3:
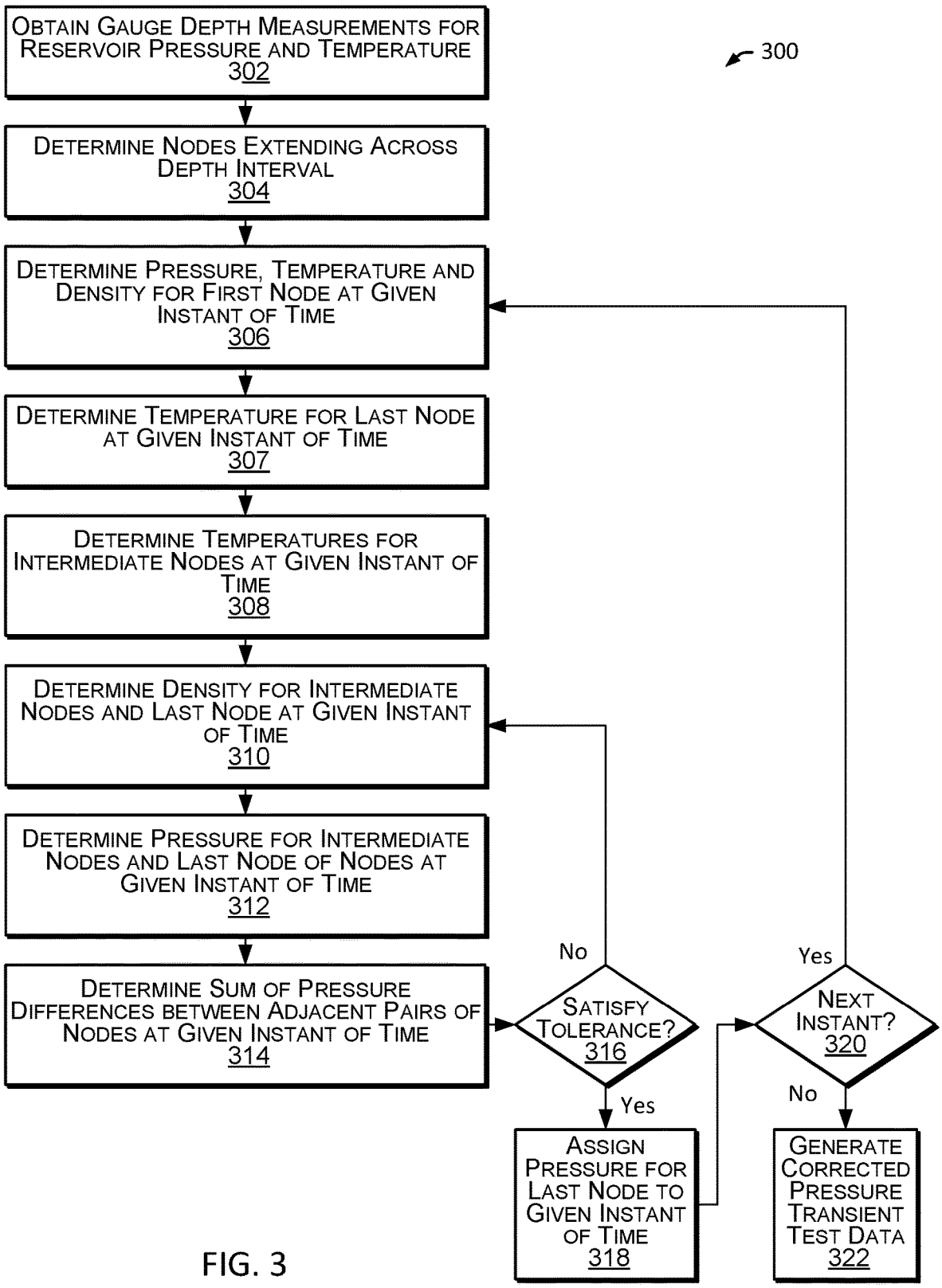
FIG. 3 is a flowchart that illustrates a method of correcting pressure transient test data in accordance with one or more embodiments.

FIG. 3 is a flowchart that illustrates a method 300 of correcting pressure transient test data (to generate corrected pressure transient test data) in accordance with one or more embodiments. In the context of the well 106, some or all of the operations of method 300 may be performed by the well control system 124 (or another operator of the well 106).

In the illustrated embodiment, method 300 includes obtaining gauge depth measurements for reservoir pressure and temperature (block 302). This may include obtaining a set of time series measurements of pressure and temperature obtained during a pressure transient test, such as a well build-up test or a well draw-down test. For example, this may include the well control system 124 (or another operator of the well 106) obtaining the transient pressure test data 140 that includes gauge depth measurements for the wellbore 120, including, for each of different instants of time of a time period: a measurement of pressure obtained by way of the pressure gauge 128; and a measurement of temperature obtained by way of the temperature gauge 130.

In the illustrated embodiment, method 300 includes determining nodes extending across a depth interval (block 304). This may include determining consecutive segments of a wellbore extending between the gauge depth and a mid-reservoir depth. For example, this may include the well control system 124 (or another operator of the well 106) performing the following: determining a depth interval ($z_0$) extending between the gauge depth (GD) and the mid-reservoir depth (MRD) in the wellbore 120 (e.g., as described with regard to FIG. 4); dividing the depth interval ($z_0$) into a series of consecutive nodes (e.g., nodes 1 to n+1) extending across the depth interval ($z_0$), where each of the nodes represents a respective depth within the depth interval ($z_0$), where a first node of the series of consecutive nodes (e.g., node 1) corresponds to the gauge depth (GD) and a last node of the series of consecutive nodes (e.g., node n+1) corresponds to the mid-reservoir depth (MRD), and intermediate nodes are defined by the nodes (e.g., nodes 2 to n) located between the first node and the last node.

In the illustrated embodiment, method 300 includes determining pressure, temperature and density for a first node at a given instant of time (block 306). This may include determining pressure, temperature and density for a first/uppermost/shallowest node for the given instant of time. For example, this may include the well control system 124 (or another operator of the well 106) determining the measured value of pressure for the given instant of time, determining the measured value of pressure for the given instant of time, determining a temperature for the depth of the first node (e.g., based on a temperature measured at the gauge depth (GD) associated with the first node, or an application of the measured temperature and a known temperature gradient for the reservoir 102 to determine the temperature at the gauge depth (GD) associated with the first node), and determining a density for the first node (e.g., based a known correlation of the pressure, the temperature determined for the depth associated with the first node, and a known composition of the wellbore fluid in the wellbore 120), and associating, with the first node, the measured value of pressure for the given instant of time, the temperature determined for the depth associated with the first node, and the density determined for the first node. Where the temperature is measured at the depth associated with the first node (e.g., at the gauge depth), the measured temperature may be determined to be the temperature for the depth of the first node.

In the illustrated embodiment, method 300 includes determining temperature for the last node (block 307) and the intermediate nodes (block 308) for the given instant of time. This may include determining pressure, temperature and density for each of the intermediate nodes and the last node, for the given instant of time. For example, this may include the well control system 124 (or another operator of the well 106) determining, for each of the nodes, a temperature for the depth (z) associated with the node (e.g., based on the temperature measured at the depth associated with the node, or an application of the measured temperature and a known temperature gradient for the reservoir 102 to determine the temperature at the depth associated with the node), and associating the determined temperature for the depth (z) with the node.

In the illustrated embodiment, method 300 includes determining estimated density for the intermediate nodes and the last node for the given instant of time (block 310). This may include iteratively estimating a density for the node based on the estimated temperature and the last updated pressure at the node. One of the suitable correlations provided in "Reservoir-Fluid Property Correlations—State of the Art," McCain, W. D. Jr., SPE Reservoir Engineering 6(2), pp. 266-272, May 1991, can be utilized to accomplish this step.

In the illustrated embodiment, method 300 includes determining estimated pressure for the intermediate nodes and the last node for the given instant of time (block 312). This may include estimating a pressure for each node based on the estimated density for the node and the estimated temperature for the node. For example, this may include the well control system 124 (or another operator of the well 106) estimating, for each node, a pressure for the node based on a known correlation of pressure, the estimated temperature determined for the node, and the known composition of the wellbore fluid in the wellbore 120 to the estimated density for the node, and associating, with the node, the estimated pressure determined for the node. This step may be accomplished by employing Equation 5 (which is an intermediate version of Equation 3) with the updated values of density in the nodes above the current node j down to the current node j:

$$p_j^{k+1}(t) = p_{GD}(t) + \frac{\Delta z}{288}\sum_{l=1}^{j}(\rho_{zl}^k + \rho_{zl+1}^k) \tag{5}$$

where:

j is the index for the current node;

k is the index for iteration;

l is the index for counting all the nodes above and including the current node j;

$\Delta z$ is segment thickness (e.g., in feet);

$\rho_{zl}$ is fluid density at lth node as a function of $p_l$ and $T_l$ (e.g., in $lb_m/ft^3$);

$p_j$ is pressure at jth node (e.g., in $lb_m/ft^3$);

$p_l$ is pressure at lth node (e.g., in $lb_m/ft^3$); and $T_l$ is temperature at lth node (e.g., in degrees Fahrenheit).

In the illustrated embodiment, method 300 includes determining a sum of pressure differences between adjacent pairs of nodes at the given instant of time (block 314) and determining whether the sum of the absolute differences of the pressures is below a specified tolerance value (block 316). This may include estimating a pressure for each node based on the estimated density for the node and the estimated temperature for the node. For example, this may include the well control system 124 (or another operator of the well 106), (i) determining, for each of pair of consecutive nodes of the series of consecutive nodes, an absolute difference between the pressures associated with the pair of consecutive nodes, (ii) determining a sum of the absolute differences of the pressures; and (iii) determining whether the sum of the absolute differences of the pressures is below a user specified tolerance value.

In the illustrated embodiment, method 300 includes, in response to determining that the sum of the absolute differences of the pressures is below the user specified tolerance value, proceeding to assign the pressure value associated with the last node as a corrected mid-reservoir depth (MRD) pressure for the instant of time (block 318) and determining if there are unassessed instants of time (block 320). In response to determining if there are unassessed instants of time, proceeding to conduct a similar assessment for the next unassessed instant of time to determine a mid-reservoir depth (MRD) pressure for the next instant of time. This may be repeated until it is determined that there are no unassessed instants of time, and method 300 may proceed to generating corrected pressure transient test data (block 322). This may include generating corrected pressure transient test data that includes the corrected mid-reservoir depth (MRD) pressures for the instants of time. For example, this may include the well control system 124 (or another operator of the well 106) assembling corrected pressure transient test data 150 that include a time series set of data points corresponding to the corrected mid-reservoir depth (MRD) pressures for each of the instants of time.

Figure 5:
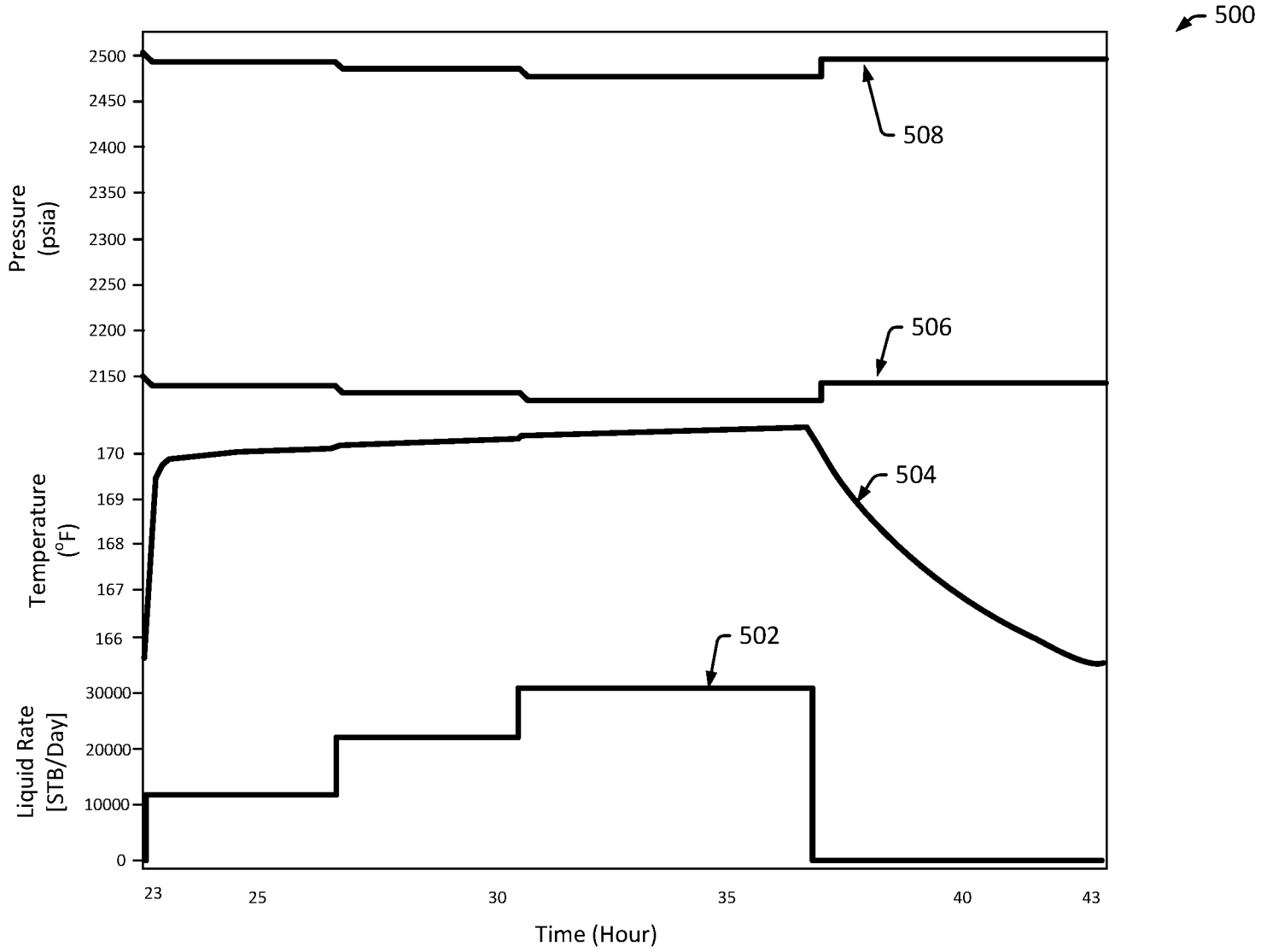
FIG. 5 is a diagram that illustrates example pressure transient test data in accordance with one or more embodiments.
Figures 6, 7:
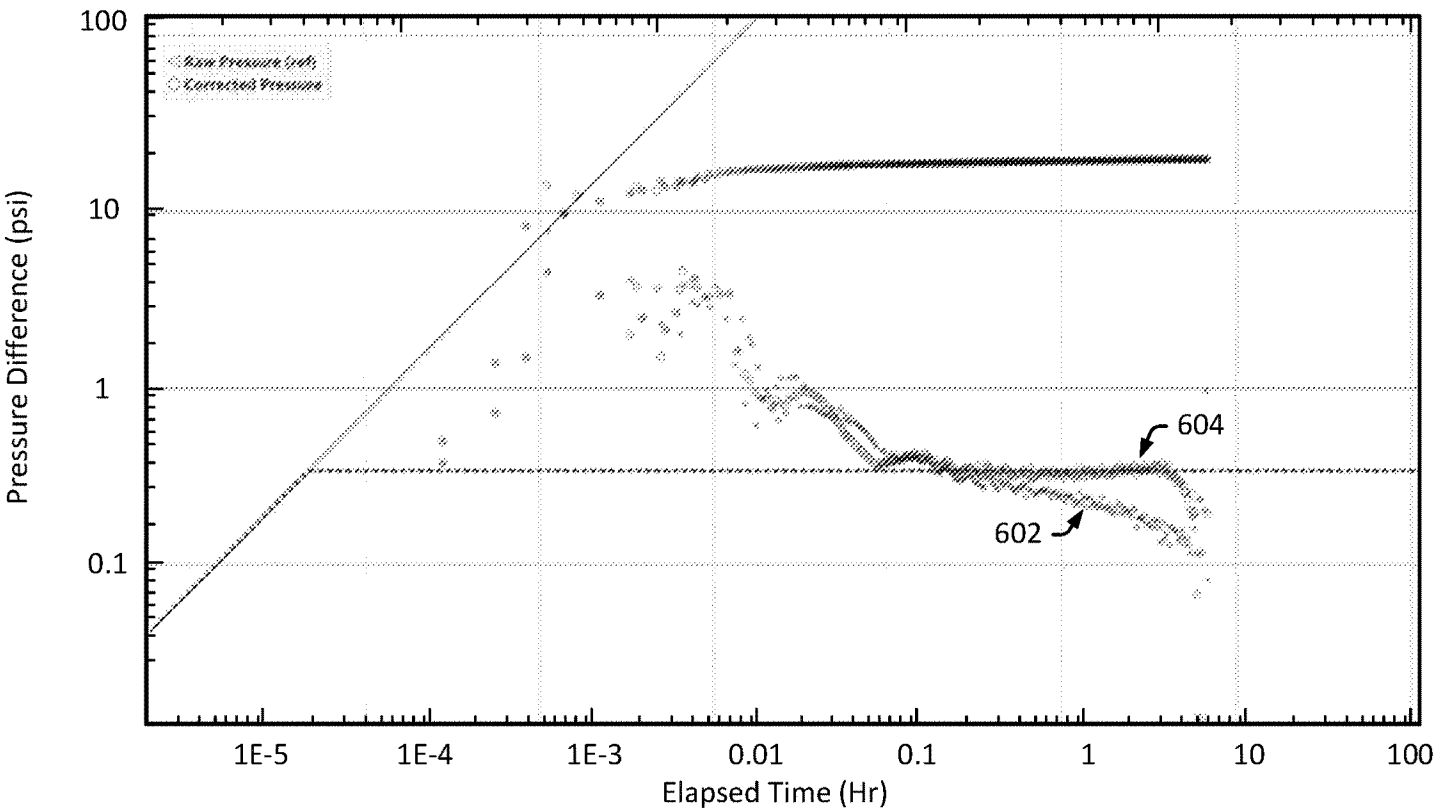
FIG. 6 is a diagram that illustrates plots of example raw pressure transient test data and corrected pressure transient test data in accordance with one or more embodiments.
FIG. 7 is a table that illustrates example parameters for correcting the pressure transient test data of FIGS. 5 and 6 in accordance with one or more embodiments.

FIG. 5 is a diagram that illustrates example pressure transient test data in accordance with one or more embodiments. The example pressure transient test data includes a plot of a well production rate versus time 502, a plot of measured reservoir temperature versus time 504, a plot of measured reservoir pressure versus time 506, and a corresponding plot of corrected reservoir pressure versus time 508. FIG. 6 is a diagram that illustrates a plot of a pressure derivative of the measured reservoir pressure 602 and a plot of a pressure derivative of the corrected reservoir pressure 604. As can be seen, the corrected reservoir pressure has an offset of about 350 psia (relative to the measured reservoir pressure). Although this offset may be generally attributable to the additional hydrostatic pressure due to the mid-reservoir depth versus gauge depth, the differences in the pressure derivative curves highlight small differences in the pressure changes that would be inaccurately characterized by uncorrected measures of reservoir pressure.

FIG. 7 is a table that illustrates example parameters for correcting the pressure transient test data of FIGS. 5 and 6 in accordance with one or more embodiments.

Figure 8:
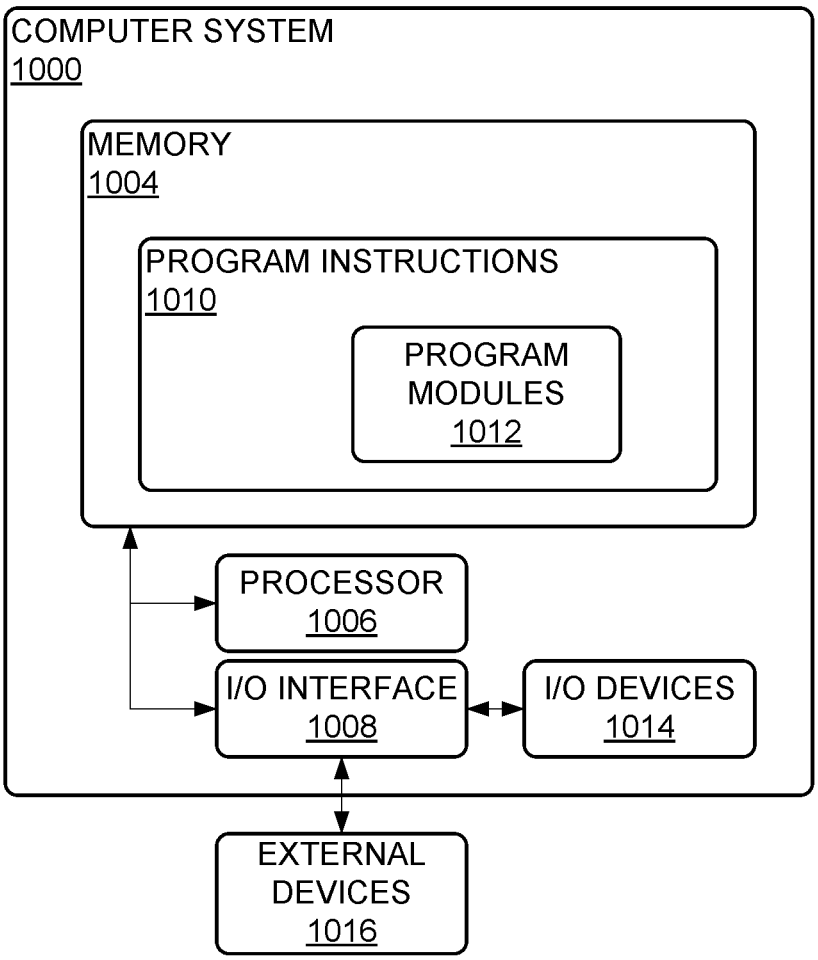
FIG. 8 is a diagram that illustrates an example computer system in accordance with one or more embodiments.

FIG. 8 is a diagram that illustrates an example computer system (or "system") 1000 in accordance with one or more embodiments. In some embodiments, the system 1000 is a programmable logic controller (PLC). The system 1000 may include a memory 1004, a processor 1006 and an input/output (I/O) interface 1008. The memory 1004 may include non-volatile memory (for example, flash memory, read-only memory (ROM), programmable read-only memory (PROM), erasable programmable read-only memory (EPROM), electrically erasable programmable read-only memory (EEPROM)), volatile memory (for example, random access memory (RAM), static random access memory (SRAM), synchronous dynamic RAM (SDRAM)), or bulk storage memory (for example, CD-ROM or DVD-ROM, hard drives). The memory 1004 may include a non-transitory computer-readable storage medium having program instructions 1010 stored thereon. The program instructions 1010 may include program modules 1012 that are executable by a computer processor (for example, the processor 1006) to cause the functional operations described, such as those described with regard to the well control system 124 (or another operator of the well 106), the method 200 or the method 300.

The processor 1006 may be any suitable processor capable of executing program instructions. The processor 1006 may include a central processing unit (CPU) that carries out program instructions (for example, the program instructions of the program modules 1012) to perform the arithmetical, logical, or input/output operations described. The processor 1006 may include one or more processors. The I/O interface 1008 may provide an interface for communication with one or more I/O devices 1014, such as a joystick, a computer mouse, a keyboard, or a display screen (for example, an electronic display for displaying a graphical user interface (GUI)). The I/O devices 1014 may include one or more of the user input devices. The I/O devices 1014 may be connected to the I/O interface 1008 by way of a wired connection (for example, an Industrial Ethernet connection) or a wireless connection (for example, a Wi-Fi connection). The I/O interface 1008 may provide an interface for communication with one or more external devices 1016. In some embodiments, the I/O interface 1008 includes one or both of an antenna and a transceiver. The external devices 1016 may include, for example, devices of the production system 122.

Further modifications and alternative embodiments of various aspects of the disclosure will be apparent to those skilled in the art in view of this description. Accordingly, this description is to be construed as illustrative only and is for the purpose of teaching those skilled in the art the general manner of carrying out the embodiments. It is to be understood that the forms of the embodiments shown and described here are to be taken as examples of embodiments. Elements and materials may be substituted for those illustrated and described here, parts and processes may be reversed or omitted, and certain features of the embodiments may be utilized independently, all as would be apparent to one skilled in the art after having the benefit of this description of the embodiments. Changes may be made in the elements described here without departing from the spirit and scope of the embodiments as described in the following claims. Headings used here are for organizational purposes only and are not meant to be used to limit the scope of the description.

It will be appreciated that the processes and methods described here are example embodiments of processes and methods that may be employed in accordance with the techniques described here. The processes and methods may be modified to facilitate variations of their implementation and use. The order of the processes and methods and the operations provided may be changed, and various elements may be added, reordered, combined, omitted, modified, and so forth. Portions of the processes and methods may be implemented in software, hardware, or a combination of software and hardware. Some or all of the portions of the processes and methods may be implemented by one or more of the processors/modules/applications described here.

As used throughout this application, the word "may" is used in a permissive sense (that is, meaning having the potential to), rather than the mandatory sense (that is, meaning must). The words "include," "including," and "includes" mean including, but not limited to. As used throughout this application, the singular forms "a", "an," and "the" include plural referents unless the content clearly indicates otherwise. Thus, for example, reference to "an element" may include a combination of two or more elements. As used throughout this application, the term "or" is used in an inclusive sense, unless indicated otherwise. That is, a description of an element including A or B may refer to the element including one or both of A and B. As used throughout this application, the phrase "based on" does not limit the associated operation to being solely based on a particular item. Thus, for example, processing "based on" data A may include processing based at least in part on data A and based at least in part on data B, unless the content clearly indicates otherwise. As used throughout this application, the term "from" does not limit the associated operation to being directly from. Thus, for example, receiving an item "from" an entity may include receiving an item directly from the entity or indirectly from the entity (for example, by way of an intermediary entity). Unless specifically stated otherwise, as apparent from the discussion, it is appreciated that throughout this specification discussions utilizing terms such as "processing," "computing," "calculating," "determining," or the like refer to actions or processes of a specific apparatus, such as a special purpose computer or a similar special purpose electronic processing/computing device. In the context of this specification, a special purpose computer or a similar special purpose electronic processing/computing device is capable of manipulating or transforming signals, typically represented as physical, electronic or magnetic quantities within memories, registers, or other information storage devices, transmission devices, or display devices of the special purpose computer or similar special purpose electronic processing/computing device.

What is claimed is:

1. A method of developing a reservoir, the method comprising:

obtaining transient pressure test data comprising gauge depth measurements at a gauge depth for a wellbore of a well extending into the reservoir, the gauge depth located at a distance above a mid-reservoir depth in the wellbore, the gauge depth measurements comprising, for each of different instants of time of a time period:

a measurement of pressure obtained by way of a pressure gauge located at the gauge depth in the wellbore; and a measurement of temperature obtained by way of a temperature gauge located at the gauge depth in the wellbore, determining a depth interval extending between the gauge depth and the mid-reservoir depth in the wellbore;

dividing the depth interval into a series of consecutive nodes extending across the depth interval, wherein each node of the series of consecutive nodes represents a respective depth within the depth interval, wherein a first node of the series of consecutive nodes corresponds to the gauge depth and a last node of the series of consecutive nodes corresponds to the mid-reservoir depth, and intermediate nodes are defined by nodes located between the first node and the last node;

for each instant of time of the instants of time:

determining, based on the measurement of pressure for the instant of time and the measurement of temperature for the instant of time, a first density of wellbore fluid;

associating, with the first node of the series of consecutive nodes, the measurement of pressure for the instant of time, the measurement of temperature for the instant of time, and the first density of wellbore fluid;

for each intermediate node:

determining, based on the measurement of temperature for the instant of time associated with the first node, an estimated temperature for the intermediate node and associating the estimated temperature with the intermediate node; and determining, based on the estimated temperature for the intermediate node, an estimated density for the intermediate node and associating the estimated density with the intermediate node;

determining, based on the measurement of temperature for the instant of time associated with the first node, an estimated temperature at the mid-reservoir depth and associating the estimated temperature with the last node;

determining, based on the estimated temperature at the mid-reservoir depth associated with the last node, an estimated density for the last node and associating the estimated density with the last node;

for each node of the intermediate nodes and the last node:

determining, based on the estimated density associated with the node, an estimated pressure for the node and associating the estimated pressure with the node;

for each of pair of consecutive nodes of the series of consecutive nodes, determining an absolute difference between the estimated pressures associated with the pair of consecutive nodes;

determining a sum of the absolute differences;

determining whether the sum of the absolute differences is below a specified tolerance value;

in response to determining that the sum of the absolute differences is below the specified tolerance value, determining the estimated pressure associated with the last node to be a corrected mid-reservoir pressure for the instant of time;

determining, based on the corrected mid-reservoir pressures determined for the instants of time, corrected pressure transient test data comprising a corrected mid-reservoir pressure profile for the time period comprising the corrected mid-reservoir pressures determined for the instants of time;

determining, based on the corrected pressure transient test data, a reservoir development parameter; and developing the reservoir based on the reservoir development parameter.

2. The method of claim 1, wherein the specified tolerance value is user specified.

3. The method of claim 1, wherein the specified tolerance value is in a range of $10^{-8}$ to $10^{-5}$ pounds per square inch.

4. The method of claim 1, wherein determining the reservoir development parameter comprises conducting a pressure transient analysis of the mid-reservoir pressure profile for the time period to determine a derivative of pressure over the time period, and wherein the reservoir development parameter is determined based on the derivative of pressure over the time period.

5. The method of claim 1, wherein the reservoir development parameter comprises a well operating pressure or a well operating flow rate, and wherein developing the reservoir comprises operating the well in accordance with the well operating pressure or the well operating flow rate.

6. The method of claim 1, wherein the reservoir comprises a hydrocarbon reservoir or an aquifer.

7. A reservoir development system, comprising:

a pressure gauge located at a gauge depth in a wellbore of a well extending into a reservoir, the gauge depth located at a distance above a mid-reservoir depth in the wellbore;

a temperature gauge located at the gauge depth in the wellbore; and a well control system configured to perform the following operations:

obtaining transient pressure test data comprising gauge depth measurements for the wellbore, the gauge depth measurements comprising, for each of different instants of time of a time period:

a measurement of pressure obtained by way of the pressure gauge located at the gauge depth in the wellbore; and a measurement of temperature obtained by way of the temperature gauge located at the gauge depth in the wellbore, determining a depth interval extending between the gauge depth and the mid-reservoir depth in the wellbore;

dividing the depth interval into a series of consecutive nodes extending across the depth interval, wherein each node of the series of consecutive nodes represents a respective depth within the depth interval, wherein a first node of the series of consecutive nodes corresponds to the gauge depth and a last node of the series of consecutive nodes corresponds to the mid-reservoir depth, and intermediate nodes are defined by nodes located between the first node and the last node;

for each instant of time of the instants of time:

determining, based on the measurement of pressure for the instant of time and the measurement of temperature for the instant of time, a first density of wellbore fluid;

associating, with the first node of the series of consecutive nodes, the measurement of pressure for the instant of time, the measurement of temperature for the instant of time, and the first density of wellbore fluid;

for each intermediate node:

determining, based on the measurement of temperature for the instant of time associated with the first node, an estimated temperature for the intermediate node and associating the estimated temperature with the intermediate node; and determining, based on the estimated temperature for the intermediate node, an estimated density for the intermediate node and associating the estimated density with the intermediate node;

determining, based on the measurement of temperature for the instant of time associated with the first node, an estimated temperature at the mid-reservoir depth and associating the estimated temperature with the last node;

determining, based on the estimated temperature at the mid-reservoir depth associated with the last node, an estimated density for the last node and associating the estimated density with the last node;

for each node of the intermediate nodes and the last node:

determining, based on the estimated density associated with the node, an estimated pressure for the node and associating the estimated pressure with the node;

for each pair of consecutive nodes of the series of consecutive nodes, determining an absolute difference between the estimated pressures associated with the pair of consecutive nodes;

determining a sum of the absolute differences;

determining whether the sum of the absolute differences is below a specified tolerance value;

in response to determining that the sum of the absolute differences is below the specified tolerance value, determining the estimated pressure associated with the last node to be a corrected mid-reservoir pressure for the instant of time;

determining, based on the corrected mid-reservoir pressures determined for the instants of time, corrected pressure transient test data comprising a corrected mid-reservoir pressure profile for the time period comprising the corrected mid-reservoir pressures determined for the instants of time;

determining, based on the corrected pressure transient test data, a reservoir development parameter; and developing the reservoir based on the reservoir development parameter.

8. The system of claim 7, wherein the specified tolerance value is user specified.

9. The system of claim 7, wherein the specified tolerance value is in a range of $10^{-8}$ to $10^{-5}$ pounds per square inch.

10. The system of claim 7, wherein determining the reservoir development parameter comprises conducting a pressure transient analysis of the mid-reservoir pressure profile for the time period to determine a derivative of pressure over the time period, and wherein the reservoir development parameter is determined based on the derivative of pressure over the time period.

11. The system of claim 7, wherein the reservoir development parameter comprises a well operating pressure or a well operating flow rate, and wherein developing the reservoir comprises controlling operation of the well in accordance with the well operating pressure or the well operating flow rate.

12. The system of claim 7, wherein the reservoir comprises a hydrocarbon reservoir or an aquifer.

13. A non-transitory computer readable storage medium comprising program instructions stored thereon that are executable by a processor to cause operations for developing a reservoir, the operations comprising:

obtaining transient pressure test data comprising gauge depth measurements at a gauge depth for a wellbore of a well extending into the reservoir, the gauge depth located at a distance above a mid-reservoir depth in the wellbore, the gauge depth measurements comprising, for each of different instants of time of a time period:

a measurement of pressure obtained by way of a pressure gauge located at the gauge depth in the wellbore; and a measurement of temperature obtained by way of a temperature gauge located at the gauge depth in the wellbore, determining a depth interval extending between the gauge depth and the mid-reservoir depth in the wellbore;

dividing the depth interval into a series of consecutive nodes extending across the depth interval, wherein each node of the series of consecutive nodes represents a respective depth within the depth interval, wherein a first node of the series of consecutive nodes corresponds to the gauge depth and a last node of the series of consecutive nodes corresponds to the mid-reservoir depth, and intermediate nodes are defined by nodes located between the first node and the last node;

for each instant of time of the instants of time:

determining, based on the measurement of pressure for the instant of time and the measurement of temperature for the instant of time, a first density of wellbore fluid;

associating, with the first node of the series of consecutive nodes, the measurement of pressure for the instant of time, the measurement of temperature for the instant of time, and the first density of wellbore fluid;

for each intermediate node:

determining, based on the measurement of temperature for the instant of time associated with the first node, an estimated temperature for the intermediate node and associating the estimated temperature with the intermediate node; and determining, based on the estimated temperature for the intermediate node, an estimated density for the intermediate node and associating the estimated density with the intermediate node;

determining, based on the measurement of temperature for the instant of time associated with the first node, an estimated temperature at the mid-reservoir depth and associating the estimated temperature with the last node;

determining, based on the estimated temperature at the mid-reservoir depth associated with the last node, an estimated density for the last node and associating the estimated density with the last node;

for each node of the intermediate nodes and the last node:

determining, based on the estimated density associated with the node, an estimated pressure for the node and associating the estimated pressure with the node;

for each of pair of consecutive nodes of the series of consecutive nodes, determining an absolute difference between the estimated pressures associated with the pair of consecutive nodes;

determining a sum of the absolute differences;

determining whether the sum of the absolute differences is below a specified tolerance value;

in response to determining that the sum of the absolute differences is below the specified tolerance value, determining the estimated pressure associated with the last node to be a corrected mid-reservoir pressure for the instant of time;

determining, based on the corrected mid-reservoir pressures determined for the instants of time, corrected pressure transient test data comprising a corrected mid-reservoir pressure profile for the time period comprising the corrected mid-reservoir pressures determined for the instants of time;

determining, based on the corrected pressure transient test data, a reservoir development parameter; and developing the reservoir based on the reservoir development parameter.

14. The non-transitory computer readable storage medium of claim 13, wherein the specified tolerance value is user specified.

15. The non-transitory computer readable storage medium of claim 13, wherein the specified tolerance value is in a range of $10^{-8}$ to $10^{-5}$ pounds per square inch.

16. The non-transitory computer readable storage medium of claim 13, wherein determining the reservoir development parameter comprises conducting a pressure transient analysis of the mid-reservoir pressure profile for the time period to determine a derivative of pressure over the time period, and wherein the reservoir development parameter is determined based on the derivative of pressure over the time period.

17. The non-transitory computer readable storage medium of claim 13, wherein the reservoir development parameter comprises a well operating pressure or a well operating flow rate, and wherein developing the reservoir comprises controlling operation of the well in accordance with the well operating pressure or the well operating flow rate.

18. The non-transitory computer readable storage medium of claim 13, wherein the reservoir comprises a hydrocarbon reservoir or an aquifer.

19. A method of developing a reservoir, the method comprising:

obtaining transient pressure test data comprising gauge depth measurements at a gauge depth for a wellbore of a well extending into the reservoir, the gauge depth located at a distance above a mid-reservoir depth in the wellbore, the wellbore gauge depth measurements comprising, for each of different instants of time of a time period:

a measurement of pressure obtained by way of a pressure gauge located at the gauge depth in the wellbore; and a measurement of temperature obtained by way of a temperature gauge located at the gauge depth in the wellbore, dividing a depth interval extending between the gauge depth and the mid-reservoir depth in the wellbore into a series of consecutive nodes extending across the depth interval, wherein each node of the series of consecutive nodes represents a respective depth within the depth interval, wherein a first node of the series of consecutive nodes corresponds to the gauge depth and a last node of the series of consecutive nodes corresponds to the mid-reservoir depth, and intermediate nodes are defined by nodes located between the first node and the last node;

for each instant of time of the instants of time:

determining, based on the measurement of pressure for the instant of time and the measurement of temperature for the instant of time, a first density of wellbore fluid;

for each intermediate node:

determining, based on the measurement of temperature for the instant of time, an estimated temperature for the intermediate node; and determining, based on the estimated temperature for the intermediate node, an estimated density for the intermediate node;

determining, based on the measurement of temperature for the instant of time, an estimated density for the last node;

for each node of the intermediate nodes and the last node:

determining, based on the estimated density associated with the node, an estimated pressure for the node;

determining, based on the estimated pressures determined for the instants of time, corrected pressure transient test data comprising a corrected mid-reservoir pressure profile for the time period comprising the estimated pressures determined for the instants of time;

determining, based on the corrected pressure transient test data, a reservoir development parameter; and developing the reservoir based on the reservoir development parameter.

* * * * *